United States Patent [19]

Muramatsu et al.

[11] Patent Number: 4,918,734

[45] Date of Patent: Apr. 17, 1990

[54] SPEECH CODING SYSTEM USING VARIABLE THRESHOLD VALUES FOR NOISE REDUCTION

[75] Inventors: Ryujiro Muramatsu, Yokohama; Takanori Miyamoto, Fuchu; Kazuhiro Kondo, Kokubunji; Toshiro Suzuki, Tama, all of Japan

[73] Assignee: Hitachi, Ltd., Tokyo, Japan

[21] Appl. No.: 52,395

[22] Filed: May 21, 1987

[30] Foreign Application Priority Data

May 23, 1986 [JP] Japan ..... 61-117416

[51] Int. Cl.[4] ..... G10L 3/00

[52] U.S. Cl. ..... 381/46

[58] Field of Search ..... 381/46–47, 381/36–41, 110; 364/513.5

[56] References Cited

U.S. PATENT DOCUMENTS

| | | | |
|---|---|---|---|
| 4,219,695 | 8/1980 | Wilkes et al. | 381/47 |
| 4,301,329 | 11/1981 | Taguchi | 381/37 |
| 4,351,983 | 9/1982 | Crouse et al. | 381/46 |
| 4,359,604 | 11/1982 | Dumont | 381/46 |
| 4,449,190 | 5/1984 | Flanagan et al. | 381/46 |
| 4,700,394 | 10/1987 | Selbach et al. | 381/46 |

OTHER PUBLICATIONS

Atal et al., "A New Model of LPC Excitation for Producing Natural Sounding Speech at Low Bit Rates", IEEE ICASSP 1982, pp. 614–617.

Ichifana et al., "A Speech Coding Method Using Thinned-out Residual", IEEE ICASSP 85, pp. 961–964.

Itakupa et al., "An Audio Response Unit Based on Partial Autocorrelation", IEEE Trans. Comm., vol. COM—20, No. 4, 8/72, pp. 792–797.

*Primary Examiner*—Gary V. Harkcom

*Assistant Examiner*—John A. Merecki

*Attorney, Agent, or Firm*—Antonelli, Terry & Wands

[57] ABSTRACT

A speech coding system includes apparatus for generating a variable threshold dependent upon the power of an input speech signal, and a comparator for comparing the power of the input speech signal with the variable threshold value to generate a discriminating signal for discriminating between a period when a speech continues and a period when the speech pauses, to change the coding operation for the input speech signal in accordance with the level of the discriminating signal, thereby forming voiced and unvoiced frames independently of each other.

2 Claims, 2 Drawing Sheets

SPEECH CODING SYSTEM USING VARIABLE THRESHOLD VALUES FOR NOISE REDUCTION

BACKGROUND OF THE INVENTION

The present invention relates to speech coding systems, and more particularly to a speech coding system used in telephone communication which is carried out in such a manner that a speech signal is converted into a compressed digital signal on the transmitting side and is reproduced from the compressed digital signal on the receiving side, and suitable for processing a speech signal which is generated in a noisy environment.

The signal waveform is given by a combination of fundamental waveform patterns, each of which appears two to ten times in a time interval of, for example, about 20 msec (hereinafter referred to as a "frame"). In conventional speech analysis-synthesis systems, the transmitting side performs a sampling operation for an input speech signal and extracts transmission parameters indicative of the feature and repetition period (namely, pitch period) of a fundamental waveform pattern from the sampled values of the input speech signal at each frame, and the receiving side reproduces the speech signal on the basis of the transmission parameters.

In the PARCOR (partial auto-correlation) system which is representative of one of the conventional speech analysis-synthesis systems, it is judged whether each of the frames formed in analyzing a speech signal is a voiced frame or unvoiced frame, and a reproducing operation is performed in such a manner that the output of an excitation source for generating white noise is used for the unvoiced frame and a single pulse which represents a fundamental waveform pattern and is generated at an interval equal to the pitch period thereof indicated by the transmission parameters, is used for the voiced frame. The PARCOR system, as mentioned above, uses a simple excitation source, and hence is advantageous in that a speech signal can be coded at a low bit rate but disadvantageous in that the quality of a synthesized speech is degraded. The PARCOR system is described in, for example, an article entitled "An audio response unit based upon partial auto correlation" (IEEE Transaction Communication, Vol. COM-20, pages 792 to 797, Aug., 1972).

Further, systems for improving the quality of a synthesized speech by generating a plurality of pulses representative of a fundamental waveform pattern at an interval equal to the pitch period thereof, are proposed in, for example, an article entitled "A New Model of LPC Excitation for Producing Natural-Sounding Speech at Low Bit Rates" by B. S. Atal and J. R. Remde (Proc. ICASSP 82, Vol. 1, pages 614 to 617, 1982), and an article entitled "A Speech Coding Method Using Thinned-Out Residual" by A. Ichikawa et al. (Proc. ICASSP 85, Vol. 3, pages 961 to 964, 1985).

In the above systems, in order to reduce the number of bits necessary for a coding operation, a pulse train generated at an interval equal to the pitch period of a fundamental waveform pattern is made identical with a pulse train generated at an interval equal to the pitch period of another fundamental waveform pattern, in one frame. In this case, however, information on the position of each pulse is required, and thus the number of pulses generated in one pitch period of a fundamental waveform pattern is limited. Accordingly, the quality of a synthesized speech is not satisfactory.

In order to further improve the quality of a synthesized speed, a system has been proposed for synthesizing a fundamental waveform pattern by using a predetermined number of pulses continuous to each other, in U.S. patent application Ser. No. 878,434 assigned to the assignee of the present invention (corresponding to JP-A-61-296398). In this case, information on the position of each pulse is not required. However, in all of above-mentioned speech analysis-synthesis systems, no attention is paid to the influence of a noisy environment on telephone conversations, for example, the degradation in speech quality of a telephone conversation due to the environment containing noise, for example, from the fan of an air conditioner. According to the conventional speech analysis-synthesis systems, noise which is introduced into the systems through a telephone in a period when a speech pauses, is processed in the same manner as the speech. Accordingly, a frame containing only noise is treated as a voiced frame, and thus transmission parameters extracted from noise are sent to the receiving side, to form a synthesized speech on the basis of the transmission parameters. Accordingly, the synthesized speech which is different from input noise and offensive to the ear of a listener, reaches the ear of the listener in pause of the speech, and thus the listener feels strange.

SUMMARY OF THE INVENTION

It is an object of the present invention to provide a speech coding system capable of eliminating the influence of environmental noise on telephone communication in a period when a speech pauses.

In order to attain the above object, according to an aspect of the present invention, a period when a speech continues, is discriminated from a period when the speech pauses, and transmission parameters are extracted from an input speech signal at each frame during the period when the speech continues, to form a synthesized speech on the receiving side on the basis of the transmission parameters. Further, the period when the speech pauses, is treated as an unvoiced frame.

In order to discriminate between a period when a speech continues and a period when the speech pauses, of a telephone conversation made in a noisy environment, according to another aspect of the present invention, a speech analysis-synthesis system includes means for calculating the power (or energy) of an input signal supplied from a telephone or calculating the integrated value of the power (or energy) for a predetermined time period, means for attenuating the power or the integrated value thereof at a first attenuation rate (namely, in a first output-to-input ratio) indicating a relatively small value, to obtain a first threshold value, selector means for selecting and outputting a larger one of the first threshold value and a second threshold value, means for attenuating the output of the selector means at a second attenuation rate indicating a relatively large value, to obtain the second threshold value, and comparator means for comparing the output of the selector means with the power of the input signal or the integrated value of the power. The output of the selector means serves as a variable threshold value.

When a speech signal is supplied to the speech analysis-synthesis system, input power increases abruptly, and the first threshold value increases in proportion to the input power. Hence, the first threshold value is selected by the selector means, and is then compared with the input power or the integrated value thereof.

When the first and second attenuation rates are appropriately set, the input power exceeds the variable threshold value for a period when a speech continues, and is smaller than the variable threshold value for a period when the speech pauses. Thus, the comparator means can deliver a discriminating signal for discriminating between the period when the speech continues and the period when the speech pauses. When the second attenuation rate is made small, the variable threshold value is kept relatively high even in the period when the speech pauses, and thus the whole input noise less than the variable threshold value is neglected. Accordingly, when the same signal processing as performed for an unvoiced frame in the conventional system is carried out during the output of the comparator means indicates a period when a speech pauses, a strange synthesized speech corresponding to input noise is never formed on the receiving side.

When the speech is again started and input power exceeds the variable threshold value, the output of the comparator means indicates a period when the speech continues, and ordinary processing for speech analysis and synthesis is carried out. Further, the variable threshold value is updated by the above input power. When the telephone conversation is completed, the variable threshold value decreases gradually to an initial small value.

The foregoing and other objects, advantages, manner of operation and novel features of the present invention will be understood from the following detailed description when read in connection with the accompanying drawings.

DESCRIPTION OF THE PREFERRED EMBODIMENT

Figure 1:
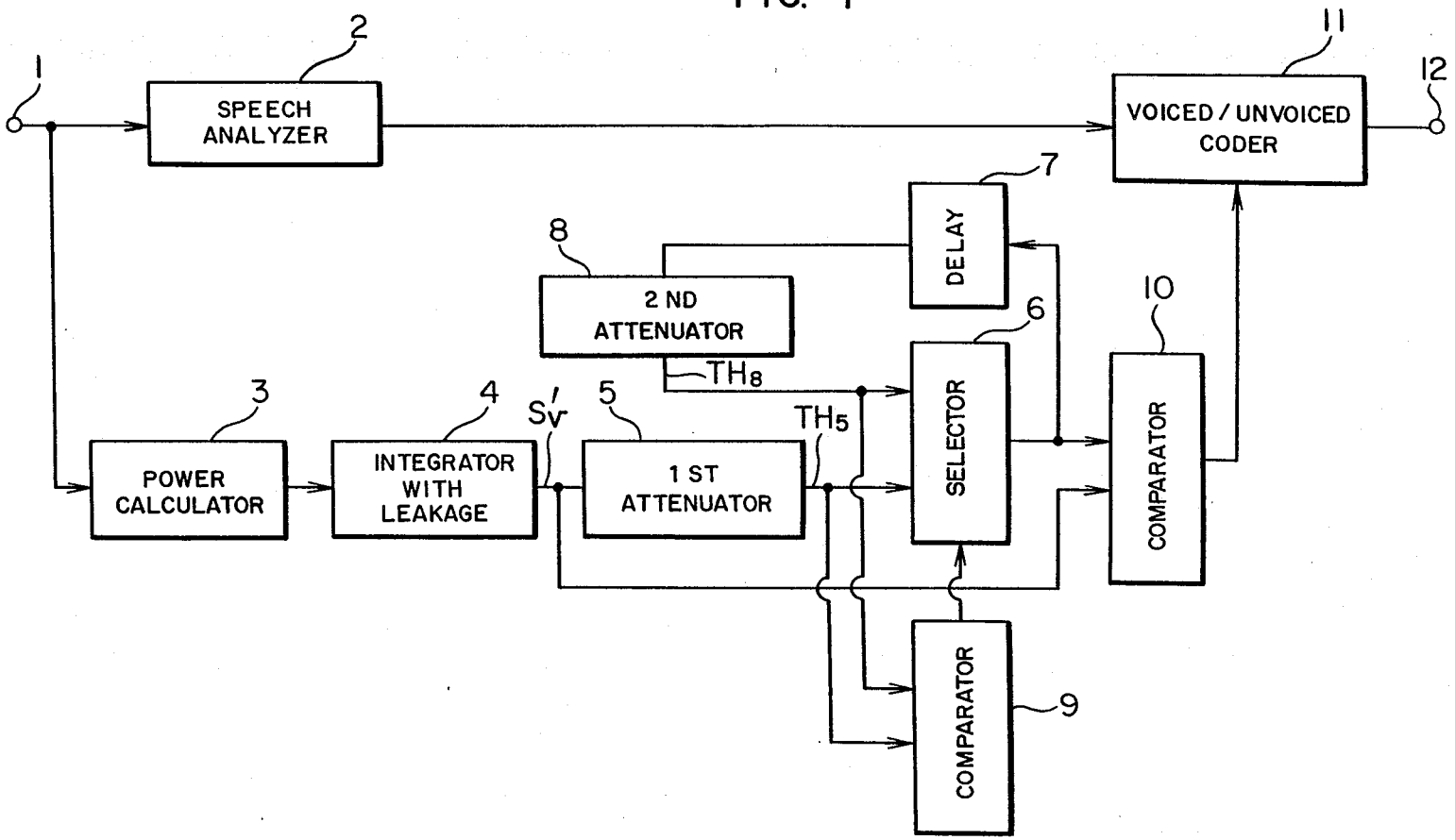
FIG. 1 is a block diagram showing an embodiment of a speech coding system according to the present invention.

FIG. 1 is a block diagram showing an embodiment of a speech coding system according to the present invention.

Referring to FIG. 1, a digitized speech signal is applied to a speech analyzer 2 and a power calculator 3 through an input terminal 1. The power calculator 3 calculates input power at each frame. For example, in a case where the speech signal of one frame is composed of n sampled data, the power calculator 3 calculates an average value by dividing the sum of squares of n data by n. In the present embodiment, in order to stabilize the circuit operation, the average values at a plurality of frames are integrated by an integrator 4 with leakage (LPF). The output of the integrator 4 is applied to a first attenuator 5 having a predetermined level attenuation rate. The first attenuator 5 is formed of a multiplier for multiplying the output $S'_v$ of the integrator 4 by, for example, an coefficient 0.5. Thus, the output level of the integrator 4 is reduced to one-half thereof. The output of the first attenuator 5 is applied to an input terminal of a selector 6 for delivering a variable threshold value, which is to be compared with the output of the integrator 4. The output of the selector 6 is applied to a delay circuit 7, which is formed of a buffer memory for storing the output of the selector 6 only for the period of one frame. That is, the delay circuit 7 delays the output of the selector 6 by the period of one frame. The output of the delay circuit 7 is applied to a second attenuator 8 having a level attenuation rate, which is made smaller than the level attenuation rate of the first attenuator 5. For example, the level attenuation rate of the second attenuator 8 is made equal to 1/10, that is, the output level of the delay circuit 7 is reduced by nine tenths thereof. The output $TH_5$ of the first attenuator 5 and the output $TH_8$ of the second attenuator 8 are applied to a comparator 9, so that they are compared with each other. It should be noted here that the output of the delay circuit 7 may be directly supplied to one of the input terminals of the comparator 9, without going through the second attenuator 8, so that the outputs of the delay circuit 7 and the first attenuator 5 are compared at the comparator 9. The selector 6 selects and delivers the larger one of the outputs $TH_5$ or $TH_8$ on the basis of the result of the comparison made by the comparator 9. The output of the selector 6 (that is, a threshold value) and the output $S'_v$ of the integrator 4 are applied to a comparator 10, to be compared with each other. For example, the output of the comparator 10 is kept at a level "1" for a period when the output $S'_v$ of the integrator 4 is not less than the output of the selector 6, to indicate a period when a speech continues. Further, the output of the comparator 10 is kept at a level "0" for a period when the output $S'_v$ of the integrator 4 is less than the output of the selector 6, to indicate a period when the speech pauses. The output of the comparator 10 is applied to a coder 11. In the period when the output of the comparator 10 takes the level "1" (that is, the period when the speech continues), the coder 11 extracts transmission parameters such as a pulse indicative of a fundamental waveform pattern and the pitch period of the pulse, from a residual signal which is delivered from the speech analyzer 2, to produce a voiced frame. In the period when the output of the comparator 10 takes the level "0", the coder 11 produces an unvoiced frame. The voiced and unvoiced frames thus obtained are successively delivered from a coded data output terminal 12. The speech analyzer 2 and the coder 11 mayb e the same ones as used in the conventional systems which are described in the above-referred articles. Each of the frames delivered from the coder 11 contains a flag for discriminating between voiced and unvoiced frames. According to the present embodiment, coded data delivered from the output terminal 12 is the same as delivered in the conventional systems, except that an input signal containing only noise whose level is smaller than a variable threshold value (namely, the output of the selector 6), is treated as an unvoiced frame. Accordingly, a conventional speech synthesizer can be used for reproducing a speech signal from a voiced frame. Further, the output of an excitation source for generating white noise is used for an unvoiced frame. Alternatively, in order to inform the receiving side of the background noise on the transmitting side, a coding method for the unvoiced frame is made different from that for the voiced frame so that a favorable signal is reproduced from the unvoiced frame.

Figure 2:
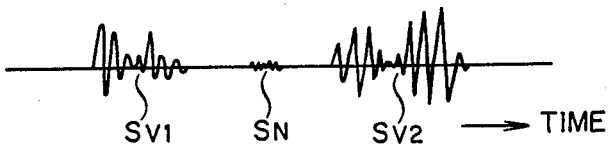
FIG. 2 is a waveform chart showing a signal which is delivered from a telephone and contains a speech signal and noise.

FIG. 2 shows an example of a waveform of signals supplied to a telephone. In FIG. 2, reference symbols $S_{v1}$ and $S_{v2}$ designate voice signals, and $S_n$ noise.

Figure 3:
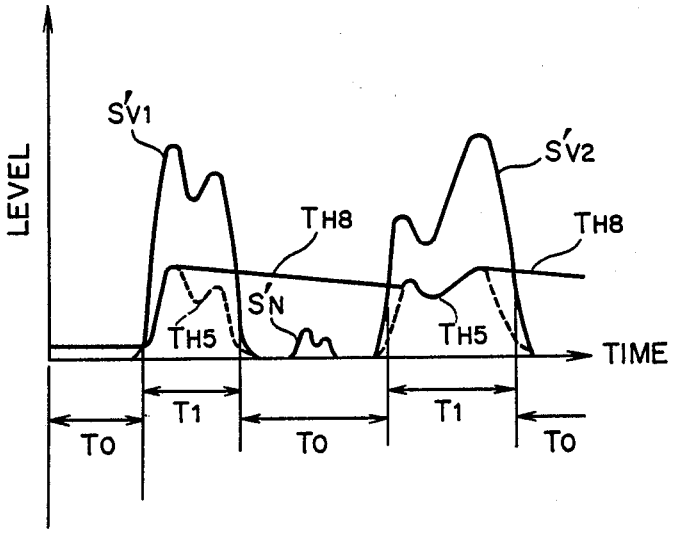
FIG. 3 is a waveform chart for explaining the operation of the above embodiment applied with, for example, the signal of FIG. 2.

FIG. 3 shows the level of output signal at various parts of the embodiment of FIG. 1, for a case where the signal of FIG. 2 is applied to the embodiment. In FIG. 3, reference simbols $S'_{v1}$ and $S'_{v2}$ designate the outputs of the integrator 4 corresponding to the voice signals $S_{v1}$ and $S_{v2}$ and $S'_n$ the output of the integrator 4 corresponding to the noise $S_n$. Further, in FIG. 3, a waveform portion $TH_5$ proportional to the outputs $S'_{v1}$ and $S'_{v2}$ of the integrator 4 indicates a threshold value delivered from the first attenuator 5, gradually varying waveform portion $TH_8$ indicates another threshold value delivered from the second attenuator 8, and a waveform which is composed of the waveform portions $TH_5$ and $TH_8$ and is expressed by a solid line, indicates a variable threshold value delivered from the selector 6.

The variable threshold value is equal to a minimum value which is set by the second attenuator 8, during a period prior to a time the voice signal $S_{v1}$ is applied to the present embodiment. When the voice signal $S_{v1}$ is applied to the embodiment and the output S'hd v1 of the integrator 4 increases, the output $TH_5$ of the first attenuator 5 which increases in proportion to the output $S'_{v1}$ of the integrator 4, serves as the variable threshold value. When the output $TH_5$ becomes smaller than a peak value, the output $TH_8$ of the second attenuator 8 serves as the variable threshold value. A period $T_1$ when the output $S'_{v1}$ or $S'_{v2}$ of the integrator 4 is not less than the variable threshold value, is judged to be a period when a speech continues. A period other than the period $T_1$ is judged to be a period $T_0$ when the speech pauses. The input speech power is far greater than noise power. Hence, noise which is introduced into the present embodiment in a period when a speech pauses, is neglected by comparing the noise with the variable threshold value. Accordingly, in the period when the speech continues, the same coding processing as in the conventional systems can be made for a voiced frame. While, in the period when the speech pauses, the processing for an unvoiced frame is carried out. Accordingly, in a speech synthesizing circuit on the receiving side, a sound which is delivered from an excitation source for generating white noise and is not offensive to the ear of a listener, is used as a reproduced sound for the unvoiced frame. Further, in a case where input noise is coded to form an unvoiced frame, the reproducing operation for the unvoiced frame is made different from that for the voiced frame so that the input noise is reproduced on the receiving side as natural background noise.

We claim:

1. A speech coding system comprising:

means for calculating the power of an input speech signal at a predetermined time interval;

first attenuator means for attenuating the power of said input speech signal at a first attenuation rate and providing a first threshold value signal;

selector means, connected to receive said first threshold value signal and a second threshold value signal, for selecting one of said first and second threshold value signals having an amplitude larger than the other of said first and second threshold value signals and outputting said selected threshold value signal;

second attenuator means for attenuating the output of said selector means at a second attenuation rate smaller than said first attenuation rate to produce said second threshold value signal, said second attenuator means including delay means for supplying said second threshold value signal to said selector means after a predetermined time delay;

comparator means for comparing the power of said input speech signal with the output of said selector means to generate a discriminating signal representative of whether the power of said input speech signal exceeds the output of said selector means; and coding means for coding said input speech signal depending on said discriminating signal delivered from said comparator means to produce a voiced frame when said discriminating signal represents that the power of said input speech signal exceeds the output of said selector means and an unvoiced frame when said discriminating signal represents that the power of said input speech signal does not exceed the output of said selector means, said voiced frame including said coded input speech signal and an indicator for indicating that said input speech signal is a voice signal, and said unvoiced frame including said coded input speech signal and an indicator for indicating that said input speech signal is an unvoiced signal.

2. A speech coding system according to claim 1, wherein said system further comprises integrator means with leakage for integrating the power of said input speech signal and outputting an integrated power signal, wherein said first attenuator means produces said first threshold value signal from the output of said integrator means, and wherein said comparator means compares the output of said selector means with the output of said integrator means to generate said discriminating signal.

* * * * *